US007607890B2

(12) United States Patent
Cunha et al.

(10) Patent No.: US 7,607,890 B2
(45) Date of Patent: Oct. 27, 2009

(54) ROBUST MICROCIRCUITS FOR TURBINE AIRFOILS

(75) Inventors: Francisco J. Cunha, Avon, CT (US); Keith A. Santeler, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 451 days.

(21) Appl. No.: 11/449,521

(22) Filed: Jun. 7, 2006

(65) Prior Publication Data

US 2007/0286735 A1 Dec. 13, 2007

(51) Int. Cl.
*F01D 5/18* (2006.01)

(52) U.S. Cl. ..... 416/97 R; 415/115

(58) Field of Classification Search ..... 415/115, 415/116; 416/97 R, 96 R
See application file for complete search history.

(56) References Cited

U.S. PATENT DOCUMENTS

2005/0031450 A1 * 2/2005 Cunha et al. ..... 416/97 R

* cited by examiner

*Primary Examiner*—Edward Look
*Assistant Examiner*—Dwayne J White
(74) *Attorney, Agent, or Firm*—Bachman & LaPointe, P.C.

(57) ABSTRACT

A cooling microcircuit for use in a turbine engine component, such as a turbine blade, having an airfoil portion is provided. The cooling microcircuit has at least one inlet slot for introducing a flow of coolant into the cooling microcircuit, a plurality of fluid exit slots for distributing a film of the coolant over the airfoil portion, and structures for substantially preventing one jet of the coolant exiting through one of the fluid exit slots from overpowering a second jet of the coolant exiting through the one fluid exit slot.

17 Claims, 3 Drawing Sheets

ROBUST MICROCIRCUITS FOR TURBINE AIRFOILS

BACKGROUND OF THE INVENTION (1) Field of the Invention

The present invention relates to an improved cooling microcircuit for use in an airfoil portion of a turbine engine component.

(2) Prior Art

In a gas turbine engine, the turbine airfoils are exposed to temperatures well above their material limits. Industry practice uses air from the compressor section of the engine to cool the airfoil material. This cooling air is fed through the root of the airfoil into a series of internal cavities or channels that flow radially from root to tip. The coolant is then injected into the hot mainstream flow through film-cooling holes. Typically, the secondary flows of a gas turbine blade are driven by the pressure difference between the flow source and the flow exit under high rotational forces. The turbine blades rotate about an axis of rotation 11. As shown in FIG. 1, to increase the convective efficiency of the cooling system in the blade, a series of cooling microcircuits 10 are placed inside the walls 12 and 14 of the airfoil portion 16. Each of the cooling microcircuits 10 has a plurality of outlets or slots 15 for allowing a film of cooling fluid to flow over external surfaces of the airfoil portion 16.

As the coolant inside each cooling microcircuit 10 heats up, the coolant temperature increases; thus, increasing the microcircuit convective efficiency. The other form of cooling which may be required for this type of turbine airfoil is film cooling as the cooling air discharges into the mainstream through a microcircuit slot 15.

FIG. 2 illustrates a cooling microcircuit configuration 18 which may be incorporated into one or more of the walls 12 and 14, typically the pressure side wall 12. The configuration 18 has three inlets 20 for introducing a cooling fluid into the microcircuit, a microcircuit pedestal bank 21, and two slot exits 22. The shape of the pedestals 24 was conceived so that a minimum metering area may be provided for the coolant flow before it enters each of the slots 22. Initially, the symmetry of each of the last pedestals 24 seems to indicate uniform flow and flow re-distribution to fill the slot exit 22. However, one of the cooling fluid jets 23, as shown in FIG. 3, tends to overpower one 25 of the other exit jets. As a result of the jet unbalance, the film exiting the cooling microcircuit slots 22 is uneven. The resulting film protection is decreased, substantially leading to entrapment of hot gases in the side of the lower momentum jet.

SUMMARY OF THE INVENTION

In accordance with the present invention, a cooling microcircuit is provided which produces substantially even jets of cooling fluid exiting the microcircuit slots.

In accordance with the present invention, there is provided a cooling microcircuit for use in a turbine engine component, such as a turbine blade, having an airfoil portion. The microcircuit broadly comprises at least one inlet slot for introducing a flow of coolant into the cooling microcircuit, a plurality of fluid exit slots for distributing a film of the coolant over the airfoil portion, and means for substantially preventing one jet of the coolant exiting through one of the fluid exit slots from overpowering a second jet of the coolant exiting through the one fluid exit slot.

Other details of the robust microcircuits for turbine airfoils of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 4:
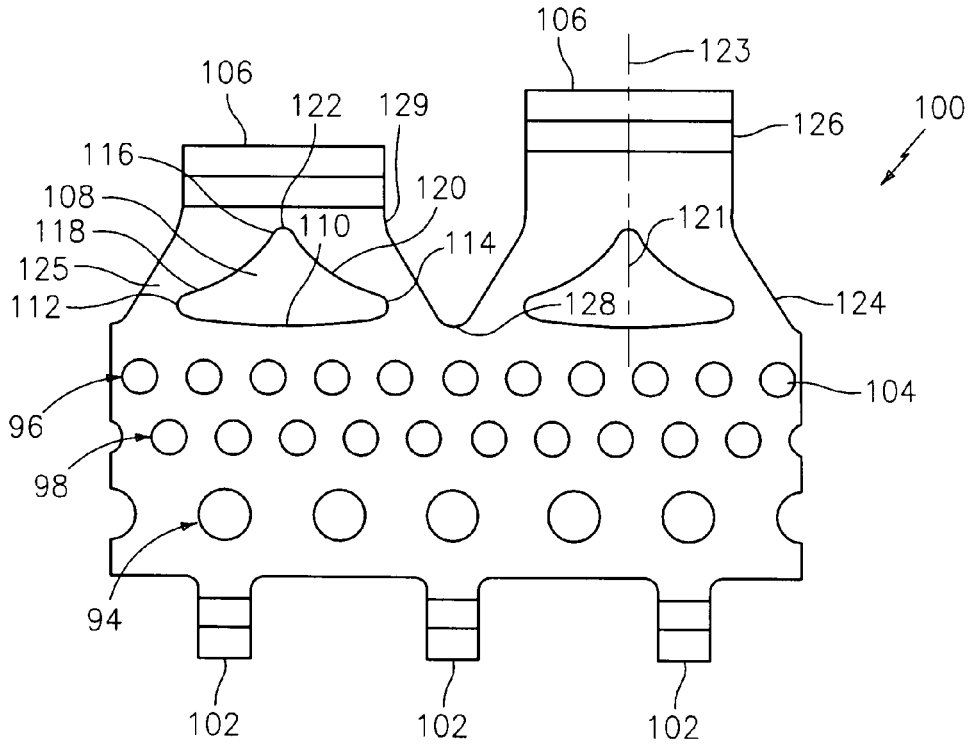
FIG. 4 is a schematic representation of a first embodiment of a cooling microcircuit in accordance with the present invention.
Figure 5:
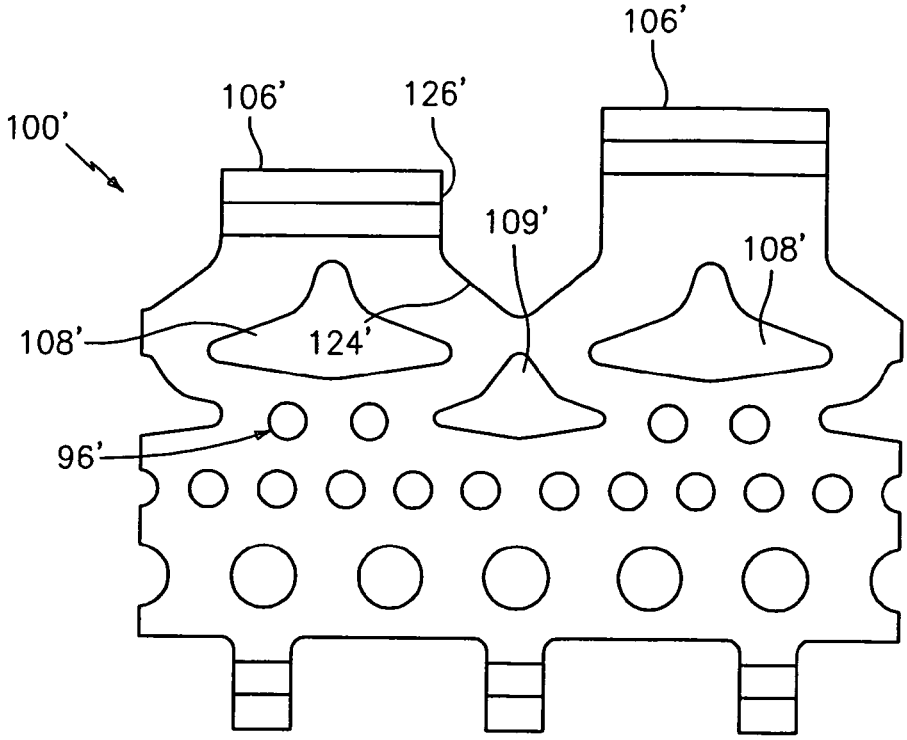
FIG. 5 is a schematic representation of a second embodiment of a cooling microcircuit in accordance with the present invention.
Figure 6:
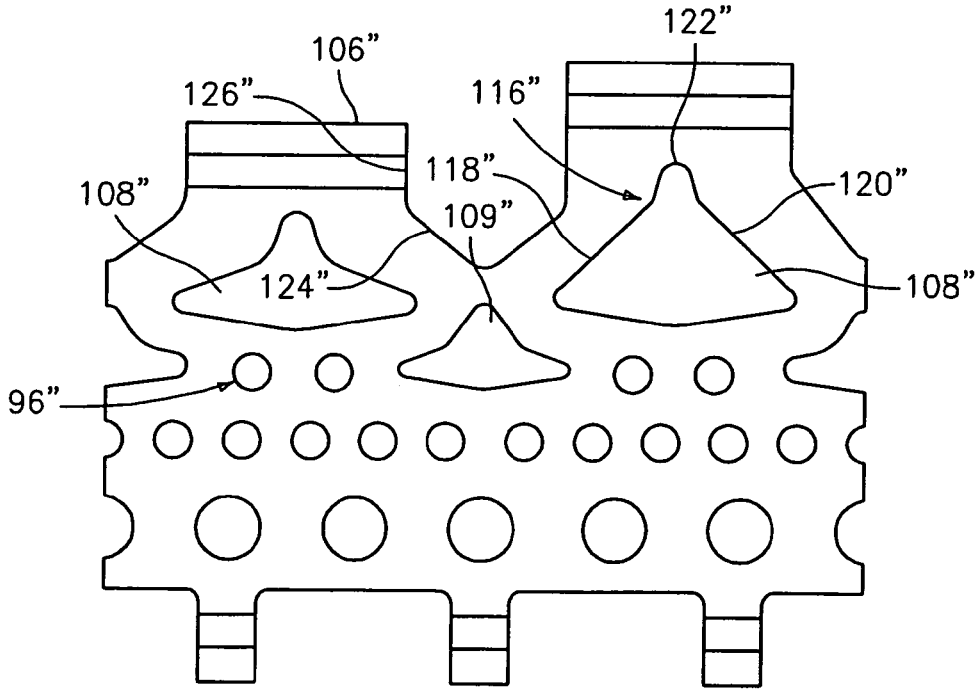
FIG. 6 is a schematic representation of a third embodiment of a cooling microcircuit in accordance with the present invention.

Referring now to FIGS. 4-6, there is shown a new cooling microcircuit arrangement 100 aimed at maintaining the flow more uniform, or substantially even, as it exits the microcircuit slots. The cooling microcircuits of the present invention may be incorporated into one or more of the pressure side and suction side walls of an airfoil portion of a turbine engine component such as a turbine blade.

As shown in FIG. 4, a cooling microcircuit 100 in accordance with the present invention has one or more cooling fluid inlet slots 102. After the cooling fluid enters the microcircuit 100, it passes through a plurality of rows of pedestals 104. The pedestals 104 may have any suitable shape known in the art. In a preferred embodiment of the present invention, the rows 94, 96, and 98 of pedestals 104 are staggered or offset with respect to each other. The pedestals 104 in one or more of the rows 94, 96, and 98 may be larger than the pedestals 104 in another one of the rows 94, 96, and 98. The cooling microcircuit 100 also has one or more fluid exit slots 106. Intermediate the last row 96 of pedestals 104 and the fluid exit slots 106 is a plurality of pedestals 108. Each pedestal 108 has an arcuately shaped leading edge portion 110, arcuately shaped side portions 112 and 114, and a trailing edge portion 116 formed from two side portions 118 and 120, preferably arcuately shaped, joined by a tip portion 122. In a preferred embodiment, each of the pedestals 108 has an axis of symmetry 121 which aligns with a central axis 123 of the slot 106.

The fluid exit slots 106 are formed with first sidewall portions 124 and second sidewall portions 126. The first sidewall portions 124 are at an angle with respect to the second sidewall portions 126. Each sidewall portion 124 begins at a point 128 which is substantially aligned with the leading edge portion 110 of each pedestal 108. Each sidewall portion 124 then extends to a point 129 substantially aligned with the tip portion 122. The sidewall portions 124 blend into the linear sidewall portions 126 and have an overall length greater than that in previous microcircuit configurations.

In the cooling microcircuit of FIG. 4, the configuration of the last pedestal 108 is used in conjunction with the sidewall portions 124 and 126 leading to the exit slots 106 to form flow channels 125 for controlling the flow of the coolant exiting through the slots 106. The combination of the sidewall portions 124 and 126 and the pedestals 108 allow for a more controlled flow of the cooling film in the flow channels 125. As a result, the jet of cooling fluid on one side of the pedestal 108 is not overpowered by the jet of cooling fluid on the other side of the pedestal 108.

Referring now to FIG. 5, there is shown a second embodiment of a cooling microcircuit 100'. In this embodiment, the microcircuit 100' is provided with the two pedestals 108' and a third pedestal 109' which is positioned intermediate the two other pedestals 108'. As can be seen from this figure, the pedestals 108' have the same configuration and location as the pedestals 108 in the embodiment of FIG. 4. The third pedestal 109' is smaller in area and arranged in an offset manner with respect to the pedestals 108'. In order to allow for the third pedestal 108', several round pedestals were removed from the row 96' closest to the exit slots 106'. The increased size of pedestal 109', relative to pedestal 96', in this configuration makes the cooling microcircuit more robust in creep resistance. Further, the minimum metering area is also changed from its location in the prior art embodiments. The location of the minimum metering area is now between adjacent pedestals 108' and 109'. This flexibility allows for a modification of the sidewall portions 124' and 126' so as to be close to the microcircuit exit slots 106'. This new arrangement of pedestals substantially prevents one jet of exiting cooling fluid flow to overpower another jet of exiting cooling fluid flow if the momentum flux between the two jets is not balanced.

Referring now to FIG. 6, in this embodiment, the cooling microcircuit 100" has a pair of pedestals 108" and a third pedestal 109" positioned intermediate the two pedestals 108". The left hand pedestal 108" and pedestal 109" each have a configuration similar to the pedestals 108 in FIG. 4. As before, the pedestal 109" occupies a portion of the last row of pedestals 96" and is smaller in area than either of the pedestals 108". In this configuration however, the right hand pedestal 108" is larger in area as compared to the area of the left hand pedestal 108". This is due to the fact that the trailing edge 116" is longer due to the longer and more linear side portions 118" and 120" which are connected by the tip portion 122". The sidewall portions 124" and 126" may be extended so as to allow for the flow of cooling fluid to be straightened out even further before exiting at the microcircuit exit slots 106". The robust design of the embodiment of FIG. 6 helps resist creep deformation (strain) of the microcircuit external wall close to the microcircuit exit slots 106"; helps prevent the ingestion of hot gases into the microcircuit exit slots 106" by having a more uniform flow at the exit slots 106"; and helps attain high film coverage for film cooling the airfoil portion 16 of a turbine engine component.

Figure 1:
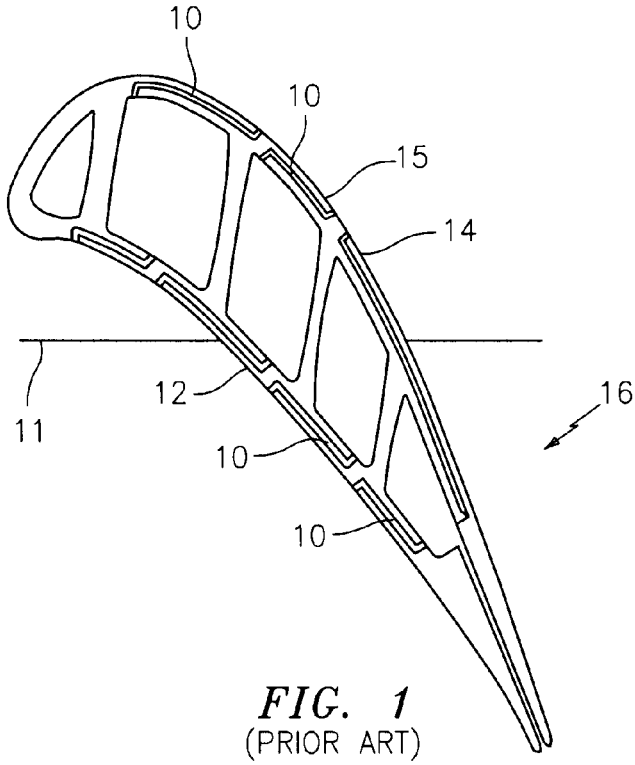
FIG. 1 (PRIOR ART)
FIG. 1 is a cross sectional view of a turbine airfoil having cooling microcircuits embedded in its wall structures.
Figure 2:
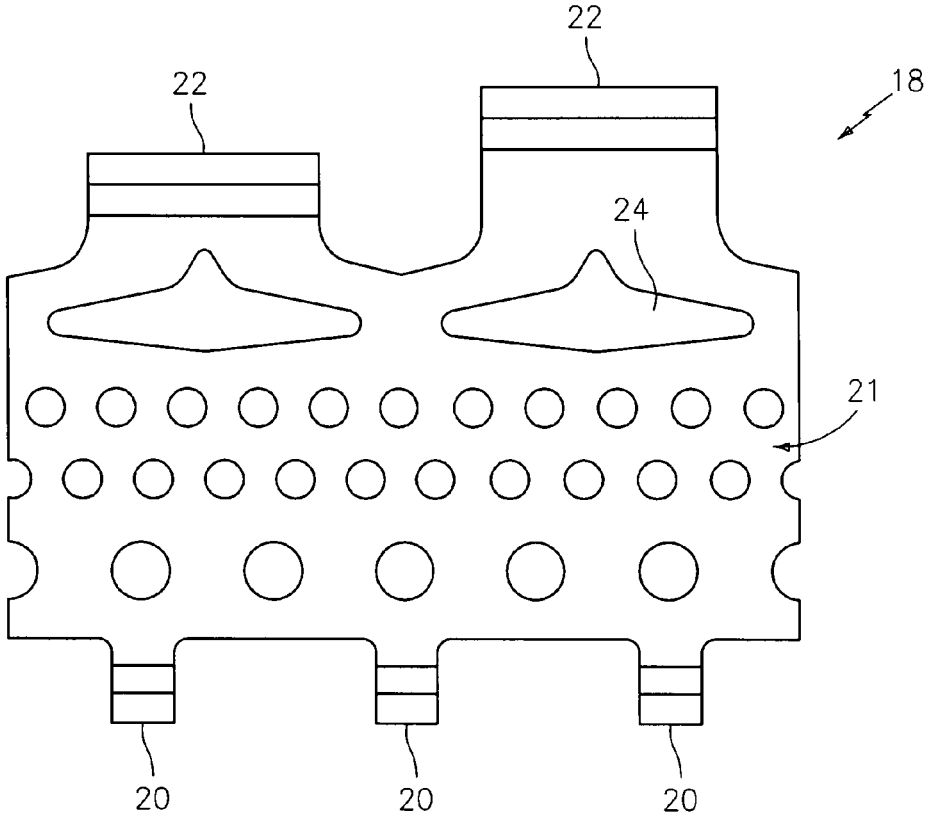
FIG. 2 (PRIOR ART)
FIG. 2 is a schematic representation of a prior art cooling microcircuit.
Figure 3:
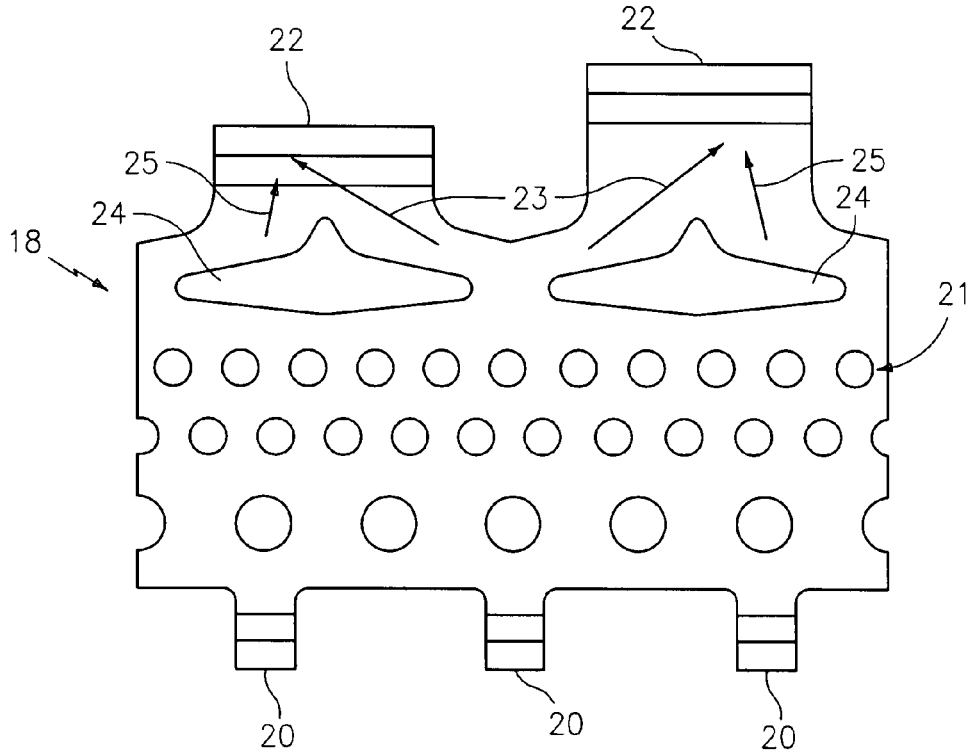
FIG. 3 (PRIOR ART)
FIG. 3 is a schematic representation of the cooling microcircuit of FIG. 2 showing overpowering jets.

The embodiments of FIGS. 4 and 6 are advantageous because they have flow channels, formed by the sidewall portions and the last pair of pedestals, in the neck region leading to the exits slots which are longer by about 25 to 75% as compared to the channel length in the prior art embodiment shown in FIG. 3. As a result, there is more time for the cooling fluid flow in the neck region to coalesce and be more in balance.

It is apparent that there has been provided in accordance with the present invention robust microcircuits for turbine airfoils which fully satisfy the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A cooling microcircuit for use in a turbine engine component having an airfoil portion, said microcircuit comprising:

at least one inlet slot for introducing a flow of coolant into said cooling microcircuit;

a plurality of fluid exit slots for distributing a film of said coolant over said airfoil portion;

each of said exit slots being provided with means for substantially preventing one jet of said coolant exiting through said fluid exit slot from overpowering a second jet of said coolant exiting through said fluid exit slot;

each said exit slot being formed by a pair of first sidewall portions and a pair of second sidewall portions joined to said first sidewall portions;

said means for substantially preventing one jet from overpowering a second jet comprising a pedestal aligned with said first sidewall portions so as to form a pair of channel each having a length sufficient to allow a flow of cooling fluid to settle down and straighten out;

each said pedestal having an arcuately shaped leading edge portion, arcuately shaped portions joined to ends of said leading edge portion, and a trailing edge portion formed by two side portions joined to said arcuately shaped portions and a tip portion joining said two side portions; and each of said first sidewall portions beginning from a point substantially aligned with said leading edge portion of each said pedestal and extending to a point substantially aligned with said tip portion of each said pedestal.

2. The cooling microcircuit of claim 1, wherein said side portions are arcuately shaped.

3. The cooling microcircuit of claim 1, further comprising at least one row of pedestals positioned between said at least one inlet slot and said exit slots.

4. The cooling microcircuit of claim 1, further comprising a plurality of rows of pedestals positioned between said at least one inlet slot and said exit slot.

5. The cooling microcircuit of claim 4, wherein the pedestals in a first one of said rows is offset with respect to the pedestals in a second one of said rows.

6. The cooling microcircuit of claim 4, wherein each of said pedestals has a circular configuration.

7. The cooling microcircuit of claim 1, further comprising a plurality of inlet slots for introducing said coolant into said microcircuit.

8. A turbine engine component having an airfoil portion with a pressure side wall and a suction side wall and at least one microcircuit embedded with one of said pressure side wall and said suction side wall and each said microcircuit comprising the cooling microcircuit of claim 1.

9. A cooling microcircuit for use in a turbine engine component having an airfoil portion, said microcircuit comprising:

at least one inlet slot for introducing a flow of coolant into said cooling microcircuit;

a plurality of fluid exit slots for distributing a film of said coolant over said airfoil portion;

each of said exit slots being provided with means for substantially preventing one jet of said coolant exiting through said fluid exit slot from overpowering a second jet of said coolant exiting through said fluid exit slot;

each said exit slot being formed by a pair of first sidewall portions and a pair of second sidewall portions joined to said first sidewall portions; and said means for substantially preventing one jet from overpowering a second jet comprising a first pedestal aligned with said exit slot and a second pedestal intermediate said first pedestals.

10. The cooling microcircuit of claim 9, wherein said second pedestal has an area which is smaller than an area of each of said first pedestals.

11. The cooling microcircuit of claim 9, wherein said first sidewall portions and said first pedestals form a pair of channels each having a length sufficient to allow a flow of cooling fluid to coalesce and straighten out prior to exiting through said exit slots.

12. The cooling microcircuit of claim 9, wherein one of said first pedestals has an area larger than an area of said other first pedestal.

13. The cooling microcircuit of claim 12, wherein said one first pedestal has a trailing edge formed by two substantially linear side portions connected by a tip portion.

14. The cooling microcircuit of claim 9, further comprising a plurality of rows of pedestals positioned between said at least one inlet slot and said exit slots and said second pedestal being positioned within a row of pedestal closest to said exit slots.

15. The cooling microcircuit of claim 9, wherein said second pedestal has an arcuately shaped leading edge portion, arcuately shaped portions joined to ends of said leading edge portion, and a trailing edge portion formed by two side portions joined to said arcuately shaped portions and a tip portion joining said two side portions.

16. The cooling microcircuit of claim 15, wherein at least one of the first pedestals has an arcuately shaped leading edge portion, arcuately shaped portions joined to ends of said leading edge portion, and a trailing edge portion formed by two side portions joined to said arcuately shaped portions and a tip portion joining said two side portions.

17. A turbine engine component having an airfoil portion with a pressure side wall and a suction side wall and at least one microcircuit embedded with one of said pressure side wall and said suction side wall and each said microcircuit comprising the cooling microcircuit of claim 9.

* * * * *

UNITED STATES PATENT AND TRADEMARK OFFICE

CERTIFICATE OF CORRECTION

PATENT NO. : 7,607,890 B2
APPLICATION NO. : 11/449521
DATED : October 27, 2009
INVENTOR(S) : Cunha et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 569 days.

Signed and Sealed this

Twelfth Day of October, 2010

David J. Kappos

David J. Kappos
*Director of the United States Patent and Trademark Office*